US007181866B2

(12) United States Patent
Braunschweiler

(10) Patent No.: US 7,181,866 B2
(45) Date of Patent: Feb. 27, 2007

(54) OUTSOLE

(75) Inventor: Hans Georg Braunschweiler, Rüschlikon (CH)

(73) Assignee: Glide'n Lock GmbH, Rüschlikon (CH)

( * ) Notice: Subject to any disclaimer, the term of this patent is extended or adjusted under 35 U.S.C. 154(b) by 0 days.

(21) Appl. No.: 10/322,808

(22) Filed: Dec. 19, 2002

(65) Prior Publication Data

US 2003/0226283 A1 Dec. 11, 2003

(30) Foreign Application Priority Data

Jun. 6, 2002 (CH) ..... 0964/02

(51) Int. Cl.
*A43B 5/00* (2006.01)

(52) U.S. Cl. ..... 36/28; 36/114

(58) Field of Classification Search ..... 36/28, 36/29, 114

See application file for complete search history.

(56) References Cited

U.S. PATENT DOCUMENTS

| | | | | | |
|---|---|---|---|---|---|
| 1,929,126 | A | * | 10/1933 | Tuki et al. | 36/28 |
| 2,100,492 | A | * | 11/1937 | Sindler | 36/29 |
| 2,627,676 | A | * | 2/1953 | Hack | 36/29 |
| 3,719,965 | A | | 3/1973 | Chevallereau | |
| 4,445,284 | A | * | 5/1984 | Sakutori | 36/3 B |
| 4,521,979 | A | * | 6/1985 | Blaser | 36/29 |
| 4,593,482 | A | * | 6/1986 | Mayer | 36/7.5 |
| 4,754,559 | A | * | 7/1988 | Cohen | 36/3 B |
| 4,910,884 | A | * | 3/1990 | Lindh et al. | 36/28 |
| 5,079,856 | A | | 1/1992 | Truelsen | |
| 5,117,566 | A | * | 6/1992 | Lloyd et al. | 36/29 |
| 5,337,492 | A | * | 8/1994 | Anderie et al. | 36/28 |
| 5,461,800 | A | * | 10/1995 | Luthi et al. | 36/28 |
| 5,686,167 | A | | 11/1997 | Rudy | |
| 5,713,140 | A | * | 2/1998 | Baggenstoss | 36/28 |
| 5,761,833 | A | | 6/1998 | McMullin | 36/67 |
| 2001/0011427 | A1 | | 8/2001 | Seydel et al. | |
| 2002/0038522 | A1 | * | 4/2002 | Houser et al. | 36/28 |

FOREIGN PATENT DOCUMENTS

| | | |
|---|---|---|
| DE | G 81 26 601.4 | 2/1982 |
| DE | 297 15 533 U1 | 3/1998 |
| DE | 298 18 243 | 3/1999 |
| EP | 1 264 556 A1 | 12/2002 |
| FR | 2 709 929 | 3/1995 |
| GB | 2 285 569 | 7/1995 |
| JP | 5-309001 | 11/1993 |
| WO | WO 81/01234 | 5/1981 |
| WO | WO 98/21991 | 5/1998 |
| WO | WO 99/51118 | 10/1999 |
| WO | WO 02/37995 | 5/2002 |

* cited by examiner

*Primary Examiner*—Marie Patterson
(74) *Attorney, Agent, or Firm*—Morgan, Lewis & Bockius, LLP

(57) ABSTRACT

An outsole (1, 3), in particular, for athletic shoes (2) can be realized with a significant elastic deformability in the tangential direction so as to also achieve a superior shock-absorption when the foot contacts the ground obliquely and with a slight propulsive force. According to the invention, the sole (1) essentially is only rigid to a tangential deformation beyond at least one critical point of deformation in the region that is deformed to this critical point. This results in a correspondingly increased stability for the runner in the respective point of contact or load application. The runner is also able to push off from the point of load application without any loss in distance. A floating effect on the sole is prevented.

10 Claims, 4 Drawing Sheets

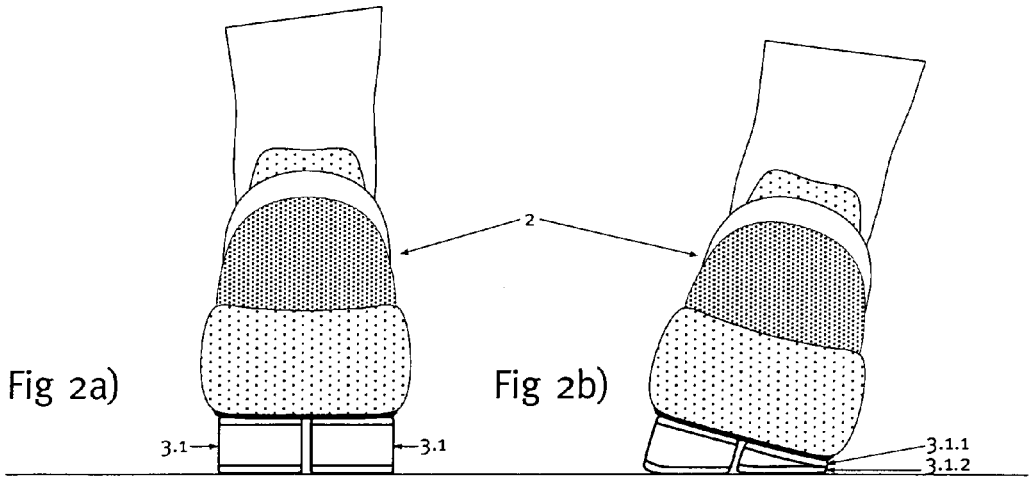
Fig 2a)
Fig 2b)
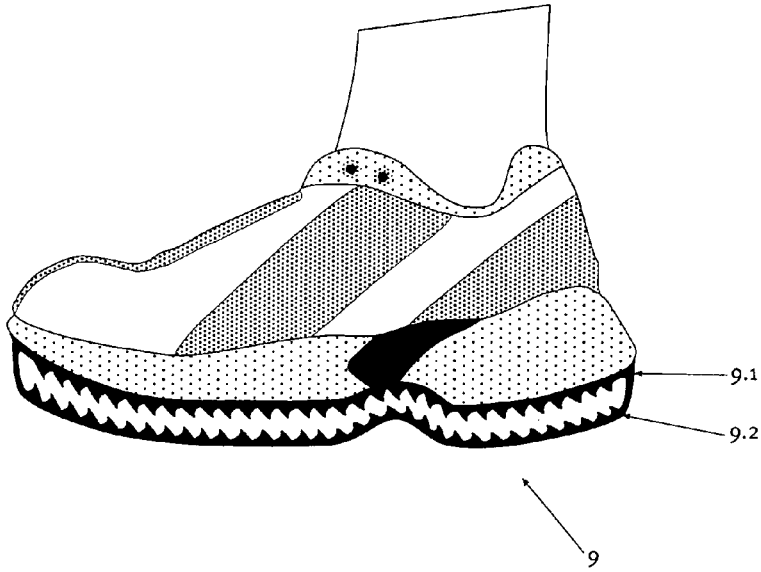
Fig 7)

OUTSOLE

TECHNICAL FIELD

The present invention pertains to an outsole, in particular, for athletic shoes which can also be elastically deformed in the tangential direction.

In this context, the term deformation in the tangential direction refers to a deformation in the direction tangential or parallel to the plane of the outsole or its outer surface which, for example, is caused by shearing. Such a deformation differs from a deformation in the direction perpendicular to the plane of the outsole or its outer surface which, for example, is caused by compression. On a horizontal surface, the tangential direction approximately coincides with the horizontal direction, and the perpendicular direction approximately coincides with the vertical direction.

STATE OF THE ART

Outsoles with elastically resilient outsoles are known in numerous variations, wherein different elastic materials of various hardnesses are used. There also exist outsoles with embedded air or gel cushions. These cushions are intended to elastically absorb the shocks that occur while running and to thusly protect, in particular, the joints of the runner while simultaneously providing a comfortable running experience.

Most athletic shoes currently available on the market have spring characteristics that primary provide a spring effect in the vertical direction or in the direction perpendicular to the running surface, namely in the form of a compression of the sole. However, these outsoles are relatively rigid in the horizontal or tangential direction and do not yield sufficiently if the runner's foot contacts the ground obliquely and with a slight propulsive force. This rigidity in the horizontal or tangential direction is required because a more significant deformability of the sole in the horizontal direction would inevitably result in a floating effect. This would negatively influence the stability of the runner. In addition, the runner would lose at least a certain distance with each step because the sole would initially have to slightly deform in the respectively opposite direction when the runner pushes off in the running direction. Naturally, this floating effect can already be observed in known athletic shoes to a certain degree.

EXPLANATION OF THE INVENTION

The present invention is based on the objective of disclosing an outsole with a simple design which makes it possible to eliminate the above-described floating effect and can also be realized sufficiently soft and resilient in the tangential direction.

This objective is attained with an outsole that can also be deformed in the tangential direction and is characterized by the fact that it essentially is only rigid to a tangential deformation beyond at least one critical point of deformation in the region that is deformed to this critical point.

If the at least one critical point of deformation and the load exerted upon the outsole required to reach this critical point of deformation are suitably chosen by adjusting the hardness or resilience of the outsole accordingly, the sole according to the invention can be realized such that it is also soft and resilient tangentially over a broad range of deformation, and that the critical point of deformation is only reached to a locally limited degree while running, namely in the zone of the sole that is subjected to the maximum load, and only around the time at which this maximum load occurs.

This not only results in a sufficient shock absorption if the runner's foot contacts the ground obliquely and/or with a slight propulsive force, but also in a superior stability at the respective point of impact or load application, from which the runner is able to directly push off again without any loss in distance. The previously described floating effect is prevented in this fashion.

It goes without saying that the critical point of deformation, at which the tangential deformability of the sole according to the invention is terminated, depends on the type of deformation. The deformation does not necessarily have to occur exclusively in the tangential direction. A critical deformation can also be reached during a purely perpendicular or vertical deformation.

According to one preferred embodiment of the invention, the critical point of deformation is only reached after a tangential and/or perpendicular deformation path that is greater than 20% of the deformable thickness of the sole, if applicable, even greater than 50% of this thickness. The absolute deformation value may easily reach a few cm.

With respect to constructive considerations and the materials used, the outsole according to the invention may, in principle, be realized in different ways. Various embodiments are described below with reference to the figures. The following description only pertains to those embodiments in which, for example, two layers of the sole are separated, in particular, by an elastically deformable element, and in which the deformable element has a sufficient deformability and makes it possible to achieve a frictional, non-positive and/or positive engagement between the two layers, namely while essentially preventing the two layers from being displaced parallel to one another.

BRIEF EXPLANATION OF THE FIGURES

The invention is described in greater detail below with reference to embodiments that are illustrated in the figures. The figures show:

FIG. 2, a rear view of the athletic shoe shown in FIG. 1, namely a) while not being subjected to a load and b) while being subjected to a laterally oblique load;

EMBODIMENTS OF THE INVENTION

Figure 1A:
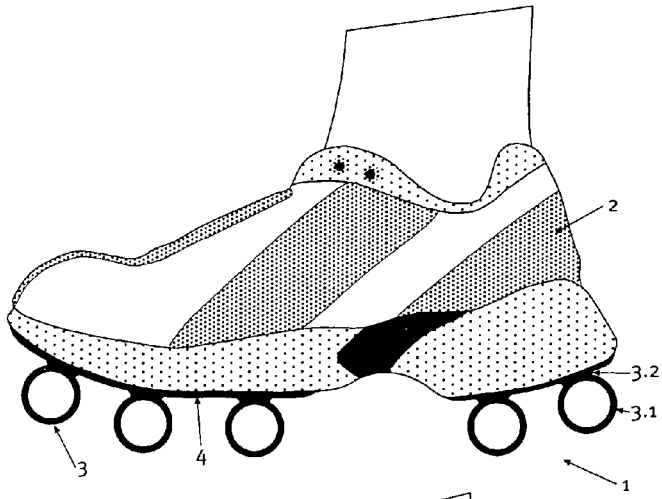
FIG. 1, a side view of an athletic shoe with an outsole according to a first embodiment of the invention, namely a) while not being subjected to a load, b) while being subjected to a transversely forward load and c) while pushing off.

One embodiment of the invention is initially described below with reference to FIG. 1. Although this embodiment does not necessarily represent the most preferred embodiment of the invention, it suffices for explaining the essential characteristics of the invention.

FIG. 1 shows a running shoe 2 that is equipped with an outsole 1 according to the invention. The outsole 1 is formed by a plurality of profile-like hollow elements 3 that contain tubular parts 3.1 and are fixed to the underside of an intermediate sole 4 of the running shoe 1 with webs 3.2 that are integrally formed thereon, e.g., by means of bonding. The hollow elements 3 are, for example, manufactured from a rubber material that is able to at least partially deform in an elastic fashion under the loads that occur while running. The material preferably has a high static friction with respect to other materials, but also with respect to itself. Several hollow elements 3 are arranged behind one another in the longitudinal direction of the running shoe 2, wherein a gap remains in the region between the ball and the heel. The hollow elements 3 may respectively extend over the entire width of the running shoe 2. However, it would also be conceivable to arrange two or more hollow elements 3 laterally adjacent to one another as shown in FIG. 2.

Figure 1B:
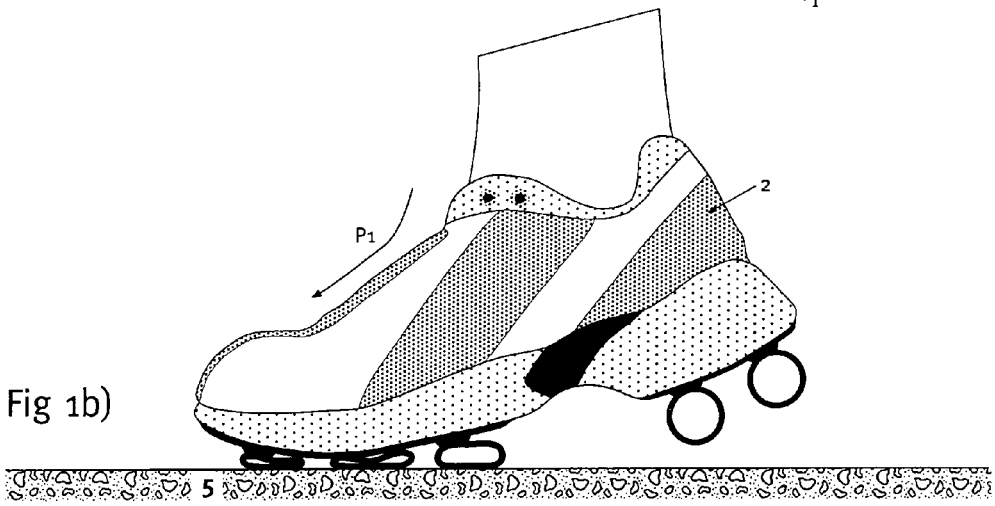

For example, if the running shoe 2 is subjected to a transversely forward load when it contacts the ground as illustrated by the arrow P1 in FIG. 1*b*), the tubular parts 3.1 are, if their dimensions are chosen accordingly, completely compressed after an initial elastic absorption of the load in the form of a vertical and horizontal deformation. This leads to a frictional engagement between their upper shell 3.1.1 and their lower shell 3.1.2 (see FIG. 3). This frictional engagement generates such a high resistance to an additional deformation of the tubular parts 3.1 that they practically can only be additionally deformed by the remaining elasticity of the material, i.e., to a negligible degree. In this position and in this state of the outsole 1, the runner is in contact with the ground 5 in such a way that a horizontal shift practically can no longer take place. This means that the runner has a superior stability.

Figure 1C:
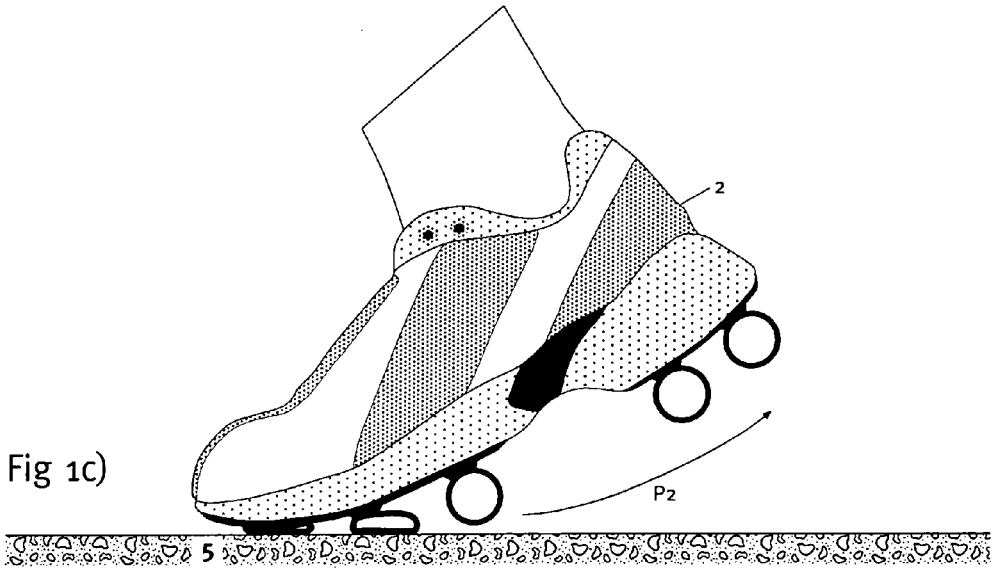

In addition, the runner is able to push off from the position shown in FIG. 2 for the next step as illustrated in FIG. 1*c*) without any loss in distance, namely because the previously described frictional engagement between the tubular parts 3.1 practically makes it impossible for these parts to horizontally deform to a noteworthy degree in the direction of the load that occurs while pushing off and is indicated by the arrow P2. Naturally, one prerequisite for this is that the load exerted upon the deformed region of the sole is maintained between the time at which the foot contacts the ground and the time at which the runner pushes off again. However, this is usually the case when running normally.

FIG. 2 shows the running shoe 2 according to FIG. 1 in the form of a rear view, namely while a) not being subjected to a load and b) while being subjected to a laterally oblique load. In this case, a compression of the tubular parts 3.1 of the hollow elements 3 can also take place such that a frictional engagement between their upper shells 3.1.1 and their lower shells 3.1.2 is produced. This means that the runner wearing the running shoe 2 is in contact with the ground 5 in such a way that a practically unyielding lateral stability is achieved.

The previously described embodiment is characterized by extremely long deformation paths. Between the state shown in FIG. 1*a*) in which no load is exerted upon the outsole and the state shown in FIG. 1*b*) in which the frictional engagement occurs, these deformation paths may easily amount to more than 20%, if applicable, even more than 50%. The shoe shown in FIGS. 1 and 2 causes the runner to "float on clouds," but the runner never has an unstable sensation and is always directly and solidly in contact with the ground.

Figure 3A:
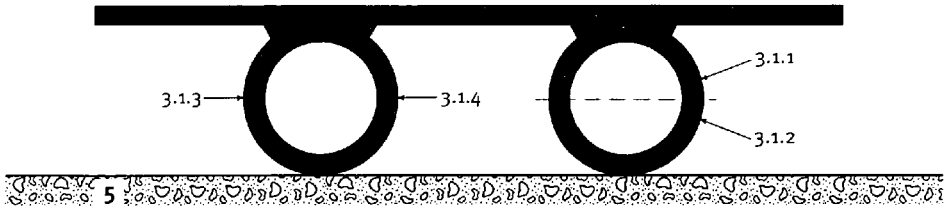
FIG. 3, detailed representations of the hollow elements of the outsole shown in FIG. 1, namely a) while not being subjected to a load, b) while being subjected to a transversely forward load and c) while being subjected to a vertical load.
Figure 3B:
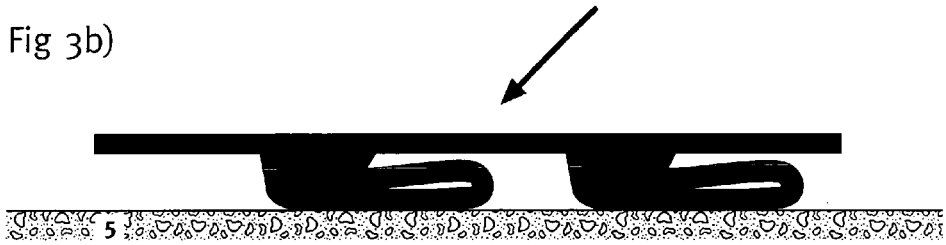
Figure 3C:
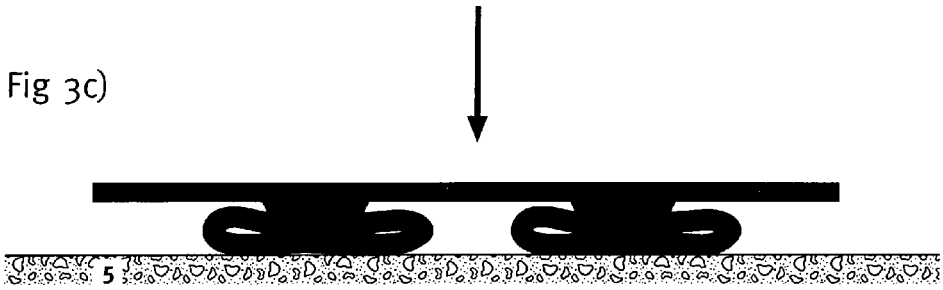

FIG. 3 shows a detailed representation of the hollow elements 3 according to FIG. 1, namely while a) not being subjected to a load and b) while being subjected to a tangential load. A deformation under a vertically downward acting load is shown in part c) of this figure. This part elucidates how the previously described advantages with respect to the stability of the runner and the ability of the runner to push off without any loss in distance are also achieved under a purely vertical load.

Figure 4B:
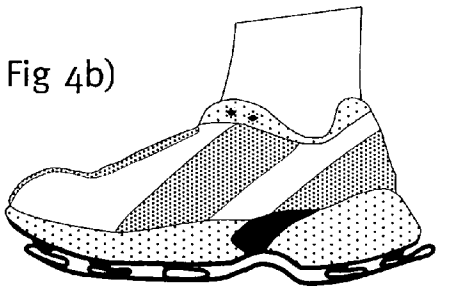
FIG. 4, a side view of another embodiment of an outsole according to the invention which comprises tubular hollow elements between the two layers, namely a) while not being subjected to a load and b) while being subjected to a transversely forward load.
Figure 4A:
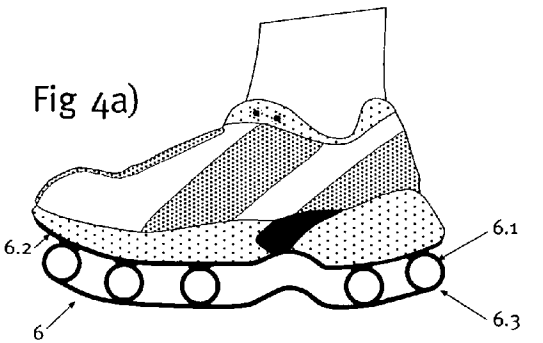

The outsole 6 shown in FIG. 4 also comprises tubular hollow elements 6.1 that, for example, consist of a rubber material. However, the hollow elements are arranged between an upper layer 6.2 and a lower layer 6.3 in this case and rigidly connected to the respective layers. The two layers 6.2 and 6.3 extend over the entire surface of the outsole. The upper layer 6.2 may, in principle, be formed by a layer that is provided anyhow or by an intermediate layer of the shoe. The lower layer 6.3 could also be provided with a profile. The function of the outsole 6 that is shown in FIG. 4 while a) not being subjected to a load basically is identical to that of the outsole 1 described above with reference to FIG. 2. When the tubular hollow elements 6.1 are compressed, a frictional engagement between their upper shell and their lower shell is, in particular, also produced in this case as shown in part b) of FIG. 4. The deformation of the hollow elements 6.1 under a load is, however, distributed over a larger area due to the thrust effect exerted by the lower layer 6.3.

Figure 5B:
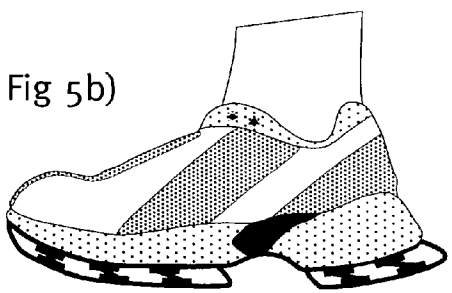
FIG. 5, a side view of an embodiment of an outsole according to the invention which is divided into a ball section and a heel section and comprises two layers that are connected to one another by means of deformable webs, namely a) while not being subjected to a load and b) while being subjected to a transversely forward load.
Figure 5A:
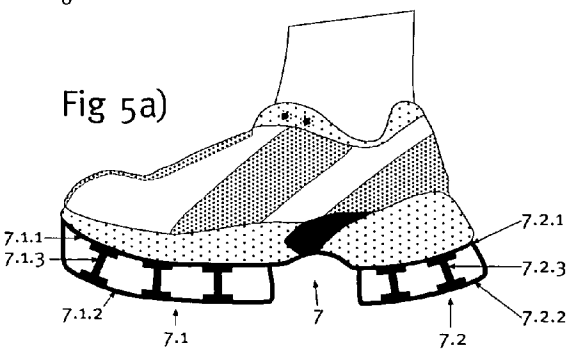

In the embodiment shown in FIG. 5, two separate parts 7.1 and 7.2 are respectively provided for the ball region and the heel region of the outsole 7. It would, in principle, also be conceivable to realize such a separate design in the other discussed embodiments. In addition, simple webs 7.1.3 and 7.2.3 that can be elastically deformed are arranged between the respective upper layers 7.1.2 and 7.2.1 and the respective lower layers 7.2.1 and 7.2.2. Under a load, these webs lie flatly between the two outer layers as, for example, illustrated in part b) of FIG. 5. If a material with a high coefficient of friction is used for the outer layers and the webs, a frictional engagement similar to that described above is produced in the situation shown in FIG. 5*b*). This means that the upper and the lower layers take over part of the function of the above-described upper and lower shells of the tubular parts shown in FIG. 1. The function of the webs, in contrast, is approximately identical to that of the flanks of the tubular parts. Two such flanks that are arranged opposite of one another are identified by the reference symbols 3.1.3 and 3.1.4 in FIG. 3.

Figure 6B:
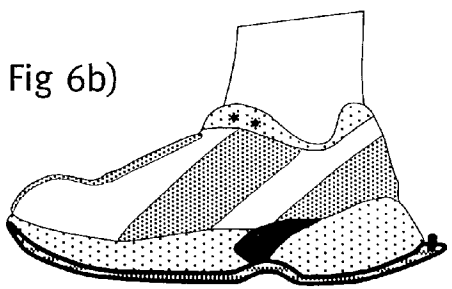
FIG. 6, an outsole according to the invention with an enclosed volume that is filled with a medium, and FIG. 7, a partially sectioned representation of an outsole according to the invention which is provided with a toothing.
Figure 6A:
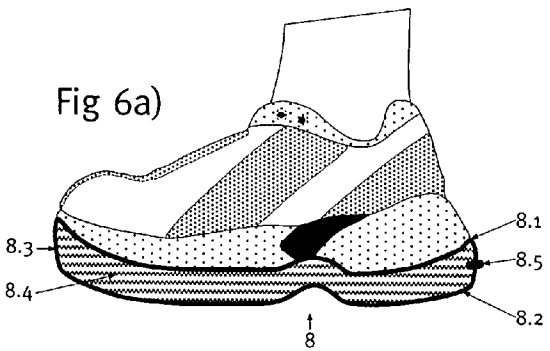

In the outsole 8 shown in FIG. 6, no elastic elements are provided between an upper layer 8.1 and a lower layer 8.2. The upper and the lower layer are connected by peripheral side elements 8.3 such that a closed volume 8.4 is formed. This closed volume is filled with a fluid, in particular, a gas such as air or, for example, a gel. In this case, it is important that the outsole can be deformed under the loads that occur while running to such a degree that, as shown in part b), the upper layer 8.1 and the lower layer 8.2 can contact one another in the region subjected to the load. A frictional engagement with the above-described properties is also produced in this case if a material with a high coefficient of friction is chosen for both layers.

If an incompressible gel is used as the medium for filling the volume 8.4, the entire volume or parts thereof need to be elastically expandable in order to achieve the desired effect. If the volume 8.4 is filled with a gas, it would be possible to provide an additional valve 8.5, e.g., in the heel region. The elastic properties and the resilience of the outsole could then be changed by varying the gas pressure in order to adapt the outsole to, for example, the weight or the running characteristics of a specific runner.

Instead of producing a frictional engagement as in the previously described embodiments, it would be possible to alternatively or additionally produce a positive engagement as shown in the partially illustrated outsole 9 according to FIG. 7. In this case, a toothing is, for example, arranged between an upper layer 9.1 and a lower layer 9.2.

With respect to the previously described embodiments, it should be noted that individual elements or characteristics thereof may, if applicable, also be utilized in combination with other embodiments. This applies, for example, to the division of the outsole into a ball section and a heel section, as well as to the arrangement of a profile. Frictional engagement means and positive engagement means may be utilized individually or in combination. The embodiments shown in FIGS. 4 or 5 could be combined with the embodiment shown in FIG. 6, wherein an elastic and/or shock-absorbing medium or fluid would be introduced into corresponding hollow spaces in the embodiments according to FIGS. 4 or 5. Vice versa, mechanical spring elements or shock-absorption elements could be additionally provided in FIG. 6.

LIST OF REFERENCE SYMBOLS

1 Outsole
2 Running shoe
3 Hollow elements
3.1 Tubular parts of the hollow elements 3
3.2 Webs of the hollow elements 3
3.1.1 Upper shell of the tubular parts 3.1
3.1.2 Lower shell of the tubular parts 3.1
3.1.3, 4.1.4 Flanks of the tubular parts 3.1
4 Intermediate sole
5 Ground
6 Outsole
6.1 Tubular hollow elements of the outsole 6
6.2 Upper layer of the outsole 6
6.3 Lower layer of the outsole 6
7 Outsole
7.1 Ball section of the outsole 7
7.2 Heel section of the outsole 7
7.1.1, 7.2.1 Upper layer of the outsole sections 7.1 and 7.2
7.2.1, 7.2.2 Lower layer of the outsole sections 7.1 and 7.2
7.1.3, 7.2.3 Deformable webs
8 Outsole
8.1 Upper layer of the outsole 8
8.2 Lower layer of the outsole 8
8.3 Peripheral side parts of the outsole 8
8.4 Volume of the outsole 8
8.5 Valve on the outsole 8
9 Outsole
9.1 Upper layer of the outsole 9
9.2 Lower layer of the outsole 9
P1 Arrow indicating the load when contacting the ground
P2 Arrow indicating the load when pushing off

The invention claimed is:

1. An outsole for a shoe, the shoe disposed along a longitudinal axis in a longitudinal direction parallel to a ground surface in use, the outsole comprising:

a resilient member having an inner surface, an outer surface and, with respect to a direction perpendicular to the longitudinal direction, an upper portion and a lower portion, the outer surface of the lower portion proximate the ground surface in use, the resilient member having first and second configurations, the first configuration having the inner surface of the upper portion spaced from the inner surface of the lower portion, the resilient member elastically absorbs shoe loads oblique to the perpendicular direction by relative motion in the longitudinal direction between the upper portion and the lower portion in the first configuration, the second configuration having the inner surface of the upper portion engaged with the inner surface of the lower portion due to absorbed shoe loads, the engagement substantially preventing relative motion in the longitudinal direction between the upper portion and the lower portion.

2. The outsole according to claim 1, wherein the engagement comprises frictional engagement.

3. The outsole according to claim 2, wherein the resilient member comprises a plurality of resilient members, the plurality of resilient members being disposed along the longitudinal axis.

4. The outsole according to claim 3, further comprising a resilient layer connecting the plurality of resilient members.

5. The outsole according to claim 4, wherein the resilient layer connects lower portions of the plurality of resilient members.

6. The outsole according to claim 2, wherein the resilient member is elastically deformed by more than 20% in the second configuration.

7. The outsole according to claim 2, wherein the resilient member is elastically deformed by more than 50% in the second configuration.

8. The outsole according to claim 1, wherein the engagement comprises positive engagement.

9. A device for wearing on a foot, comprising:

a member adapted to grasp the foot, the grasping member disposed along a longitudinal axis in a longitudinal direction parallel to a ground surface in use; and an outsole, the outsole comprising;

a resilient member having an inner surface, an outer surface, and, with respect to a direction parallel to the longitudinal direction, an upper portion and a lower portion, the outer surface of the lower portion proximate the ground surface in use, the resilient member having first and second configurations, the first configuration having the inner surface of the upper portion spaced from the inner surface of the lower portion, the resilient member elastically absorbs loads oblique to the ground perpendicular direction by relative motion in the longitudinal direction between the upper portion and the lower portion in the first configuration, the second configuration having the inner surface of the upper portion engaged with the inner surface of the lower portion due to absorbed shoe loads, the engagement substantially preventing relative motion in the longitudinal direction between the upper portion and lower portion.

10. The device according to claim 9, wherein the grasping member comprises a shoe.

* * * * *

US007181866C1

(12) INTER PARTES REEXAMINATION CERTIFICATE (1288th)

United States Patent

Braunschweiler

(10) Number: US 7,181,866 C1

(45) Certificate Issued: Jun. 24, 2016

(54) OUTSOLE

(75) Inventor: Hans Georg Braunschweiler, Rüschlikon (CH)

(73) Assignee: GLIDE'N LOCK GMBH, Ruschlikon (CH)

Reexamination Request:
No. 95/001,320, Mar. 3, 2010

Reexamination Certificate for:

| | |
|---|---|
| Patent No.: | **7,181,866** |
| Issued: | **Feb. 27, 2007** |
| Appl. No.: | **10/322,808** |
| Filed: | **Dec. 19, 2002** |

(30) Foreign Application Priority Data

Jun. 6, 2002 (CH) ..... 0964/02

(51) Int. Cl.

| | |
|---|---|
| ***A43B 5/00*** | (2006.01) |
| ***A43B 13/20*** | (2006.01) |
| ***A43B 3/24*** | (2006.01) |
| ***A43B 13/18*** | (2006.01) |
| ***A63B 25/10*** | (2006.01) |
| ***A43B 13/36*** | (2006.01) |

(52) U.S. Cl.

CPC ..... *A43B 13/206* (2013.01); *A43B 3/24* (2013.01); *A43B 3/246* (2013.01); *A43B 13/184* (2013.01); *A43B 13/203* (2013.01); *A43B 13/36* (2013.01); *A63B 25/10* (2013.01)

(58) Field of Classification Search

USPC ..... 36/28

See application file for complete search history.

(56) References Cited

To view the complete listing of prior art documents cited during the proceeding for Reexamination Control Number 95/001,320, please refer to the USPTO's public Patent Application Information Retrieval (PAIR) system under the Display References tab.

*Primary Examiner* — Cary Wehner

(57) ABSTRACT

An outsole (1, 3), in particular, for athletic shoes (2) can be realized with a significant elastic deformability in the tangential direction so as to also achieve a superior shock-absorption when the foot contacts the ground obliquely and with a slight propulsive force. According to the invention, the sole (1) essentially is only rigid to a tangential deformation beyond at least one critical point of deformation in the region that is deformed to this critical point. This results in a correspondingly increased stability for the runner in the respective point of contact or load application. The runner is also able to push off from the point of load application without any loss in distance. A floating effect on the sole is prevented.

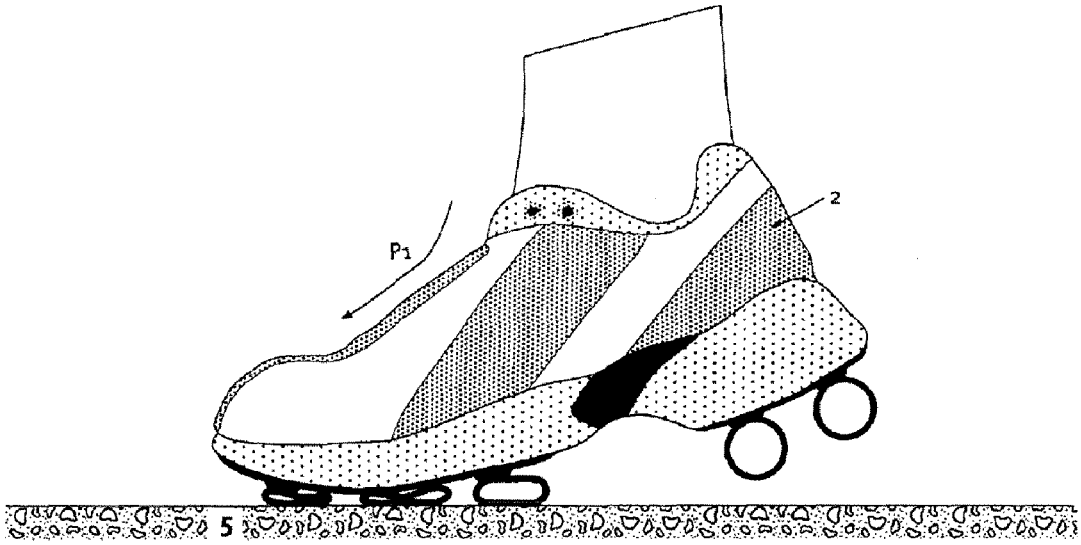

INTER PARTES REEXAMINATION CERTIFICATE

THE PATENT IS HEREBY AMENDED AS INDICATED BELOW.

AS A RESULT OF REEXAMINATION, IT HAS BEEN DETERMINED THAT:

Claims 1-10 are cancelled.

* * * * *